United States Patent [19]

Cruise

[11] Patent Number: 4,712,533

[45] Date of Patent: Dec. 15, 1987

[54] HIGH-SPEED BOW LIMBS

[76] Inventor: Billy J. Cruise, 28494 Siesta La., Eugene, Oreg. 97402

[21] Appl. No.: 866,391

[22] Filed: May 22, 1986

[51] Int. Cl.[4] ..... F41B 5/00

[52] U.S. Cl. ..... 124/23 R; 124/DIG. 1; 273/DIG. 7; 273/DIG. 23

[58] Field of Search ..... 124/23 R, 24 R, DIG. 1; 273/DIG. 23, DIG. 7, DIG. 3, 80 B

[56] References Cited

U.S. PATENT DOCUMENTS

| | | | |
|---|---|---|---|
| 2,316,880 | 4/1943 | Miller | 124/23 R |
| 2,818,057 | 12/1957 | Meyer et al. . | |
| 2,875,117 | 2/1959 | Potchen et al. | 273/DIG. 7 X |
| 2,894,503 | 7/1959 | Pierson et al. | 124/23 R |
| 2,945,488 | 7/1960 | Cravotta et al. . | |
| 2,966,903 | 1/1961 | Veneko | 124/23 R |
| 3,167,063 | 1/1965 | Kappas . | |
| 3,434,465 | 3/1969 | Stewart . | |
| 3,657,040 | 4/1972 | Shobert | 124/23 R |
| 3,659,577 | 5/1972 | Richardson et al. . | |
| 3,695,248 | 10/1972 | Izuta | 124/24 R |
| 3,850,156 | 11/1974 | Eicholtz | 124/23 R |
| 3,916,059 | 10/1975 | Molloy et al. | 273/DIG. 7 X |
| 4,214,395 | 7/1980 | Caldwell, Jr. . | |
| 4,539,253 | 9/1985 | Hirschbuehler et al. | 273/DIG. 23 X |

FOREIGN PATENT DOCUMENTS

| | | | |
|---|---|---|---|
| 54-56298 | 5/1979 | Japan | 124/23 R |

*Primary Examiner*—Randolph A. Reese
*Assistant Examiner*—Peter M. Cuomo
*Attorney, Agent, or Firm*—Chernoff, Vilhauer, McClung & Stenzel

[57] ABSTRACT

An archery bow having limbs constructed of laminae of pre-stressed fibers in a resin matrix, all of the laminae of the bow limb over at least a substantial intermediate portion of the length of the limb being pre-stressed and all of the laminae, as well as riser wedge and tip wedge portions of the limb, being adhesively interconnected in a pre-stressed configuration by an efficient adhesive. The limbs are free from any core of material which is not pre-stressed. One of the layers of material utilized in construction of the limb may contain layers of parallel pre-stressed fibers diagonally oriented with respect to the longitudinal axis of the bow limb and additional parallel pre-stressed oppositely diagonally oriented fibers, in order to stabilize the bow limb against twisting during use.

16 Claims, 8 Drawing Figures

HIGH-SPEED BOW LIMBS

BACKGROUND OF THE INVENTION

The present invention relates to archery bows and particularly to an improved bow limb of laminated resin-supported fiber construction useable either in a compound bow or a conventional bow.

In the past, archery bow limbs have included laminations of parallel glass fibers in a matrix of plastic resin material. Such laminations have been attached by adhesives to the back (the tension side) and belly (the compression side) of a core of wood or laminated wood construction to form such limbs. In construction of bow limbs having reflex curvature, recurvature, or deflex curvature, and particularly in such curved limbs for use in compound bows, the inclusion of such wooden cores has conventionally been thought necessary to avoid failure of the limbs.

Previously, it has been found necessary to include a core of wood between layers of materials such as fiber-reinforced resins adhesively attached to the back face and to the belly side of a bow whose limbs have any curvature when relaxed, because the absence of such a core has resulted in failure of the bow, should the string be released from a drawn position. The shock imposed on the materials of the belly laminations of conventional bows, including bows which include a wooden core between back and belly laminations, usually results in rapid failure of the belly laminations when the bowstring is released without the load of an arrow being shot.

The compound bow, a bow of the type first described in Allen U.S. Pat. No. 3,486,495, includes eccentric wheels or cams mounted on the tips of the bow limbs and interconnected with the bowstring by cables which make it possible to draw and hold bows whose limbs are stiffer than those of a traditional bow the same person would be able to draw. Compound bows are thus able to store increased amounts of potential energy for a given amount of tension present in the bowstring when the bow is in its fully drawn position. The limbs of compound bows are even more likely than traditional bows to fail if the bowstring is released from a drawn position without an arrow to provide a load during return of the bowstring to its straight stretched position.

For the sake of greater accuracy, it is desired to provide bows capable of propelling arrows of a given weight at a higher initial velocity than has previously been possible. This requires limbs of the bow to provide a greater amount of bowstring tension throughout a larger part of the length of the draw, yet the limb must be light enough to accelerate quickly when the bowstring is released to shoot an arrow. In the past, however, it has not been known how to build such a bow limb which is not subject to failure if the bowstring is released without an arrow.

One attempt to avoid the use of a wooden core in a bow limb is described in Pierson et al., U.S. Pat. No. 2,894,503, in which a core of randomly oriented glass fibers contained in a resin matrix extends the entire length of a bow limb between the belly and back layers.

Bear, U.S. Pat. No. 2,665,678, discloses a bow including glass fiber reinforcement in laminae supported by a wooden core, with the laminae being assembled in a pre-stressed condition.

DeGiacomo, U.S. Pat. No. 2,815,015, describes a bow of similar construction in which epoxy resins are used to protect and interconnect the glass fibers reinforcing the laminae.

Eicholz, U.S. Pat. No. 3,850,156, discloses a bow whose limbs have a laminated wood core and multiple laminations of glass fiber-reinforced material, with at least one lamina including diagonally oriented graphite fibers extending at an angle of about 30 degrees relative to the longitudinal axis of the bow limb.

Nevertheless, the need still remains for an improved bow able to withstand, unharmed, repeated release of the bowstring from a fully drawn condition without shooting an arrow, and a method for producing such a bow having limbs capable of imparting a greater amount of energy to an arrow, in order to cast the arrow at a greater initial velocity than previously has been possible using bow limbs including pre-stressed laminae attached to wooden or other cores.

SUMMARY OF THE INVENTION

The present invention provides a bow limb and a method for its construction which overcomes the aforementioned shortcomings and disadvantages of previously available archery bows. According to the present invention a bow limb is constructed of a plurality of laminae including pre-stressed, normally straight and parallel fibers of a reinforcing material such as glass or graphite in a synthetic resin matrix. A plurality of laminae of such material are adhesively joined in a pre-stressed condition in each of a belly layer and a back layer of the bow limb, with a riser wedge and a tip wedge being interposed between the back layer and belly layer at the respective ends of the limb to increase the stiffness of those portions of the limb appropriately. In an intermediate portion of the length of the limb, however, no core nor wedge is interposed between the back and belly layers of fiber-reinforced resin or similar material as has previously been considered to be absolutely necessary to avoid failure of such limbs. As a result, flexion of the limb is concentrated in the intermediate portion of its length.

The bow limb according to the invention is assembled by laying up a plurality of relatively thin laminae of resin material reinforced by pre-stressed glass fiber, appropriately bending each lamina from its normally flat condition, in which all of the fibers are straight and parallel, into the desired shape of the bow limb. A riser wedge and a tip wedge are placed appropriately between the belly and back layers of fiber reinforced laminae, leaving an intermediate portion of the limb between the opposing edges of the riser wedge and the tip wedge where the belly layer and back layer contact each other. All of the laminae and the wedges are interconnected with one another by the use of an appropriate adhesive. With all of the laminae and the wedges of the limb held securely under pressure, in the desired curved configuration, the adhesive is cured to produce a pre-stressed bow limb of the desired shape.

In a preferred embodiment of the invention at least one intermediate, torsion-resistant lamina is included among the other laminae of the back layer. The torsion-resistant lamina is similar in thickness to the other laminae forming the back layer but differs from them in that it includes reinforcing fibers oriented at an angle such as 30 degrees on either side of the longitudinal axis of the limb. Preferably, such diagonal or bias-oriented reinforcing fibers are of graphite material.

Optionally, graphite fibers may also be used in other laminae of the belly and back layers, in order to achieve a desired amount of resistance to bending of the limb constructed according to the invention.

Compared with a bow containing a core between belly and back laminations, the resultant bow limb is relatively stiff throughout the lengths of the riser wedge and tip wedge portions, yet relatively flexible throughout the intermediate portion, where the back layer and belly layer fibers are separated from one another by a shorter lever arm than is possible when such a bow limb includes a centrally located core. As a result, a bow limb according to the invention may have a draw force required to bend the bow limb, and available to propel an arrow, which is higher throughout the entire range of drawing the bow from its undrawn, strung condition to a fully drawn configuration. This results in storage of a larger total amount of potential energy. Because the limb includes no core there is no force required to accelerate the core mass, so the bow is capable of applying to an arrow the part of the elastic force that otherwise would have been used to move the core.

It is therefore a principal object of the invention to provide an improved archery bow and a method of construction of a limb thereof, of belly and back layers, each of laminated resin-supported fibrous materials, with the belly and back layers adhesively interconnected with each other without a central core located therebetween.

It is another important object of the present invention to provide a bow limb able to flex further without breakage than has previously been possible for bow limbs of a given size and stiffness.

It is a principal feature of a bow according to the present invention that it includes a plurality of laminae of pre-stressed fiber-reinforced resin material forming respective back and belly layers adhesively interconnected directly with each other defining an intermediate portion free from a core interposed between the belly and back layers.

It is another feature of the bow according to the present invention that its limbs include diagonally-oriented reinforcing fibers in at least one lamina of the pre-stressed laminated back layer thereof to oppose twisting of the limb.

It is a principal advantage of the present invention that it provides a bow whose limbs are able to impart a greater initial velocity to an arrow than has previously been possible with similar bows of the same draw weight.

It is another important advantage of the present invention that it provides a bow limb which is much less likely to fail as a result of releasing the string from a drawn condition of the bow without an arrow being nocked on the string.

The foregoing and other objectives, features and advantages of the invention will be more readily understood upon consideration of the following detailed description of the invention, taken in conjunction with the accompanying drawings.

DETAILED DESCRIPTION OF THE INVENTION

Figure 1:
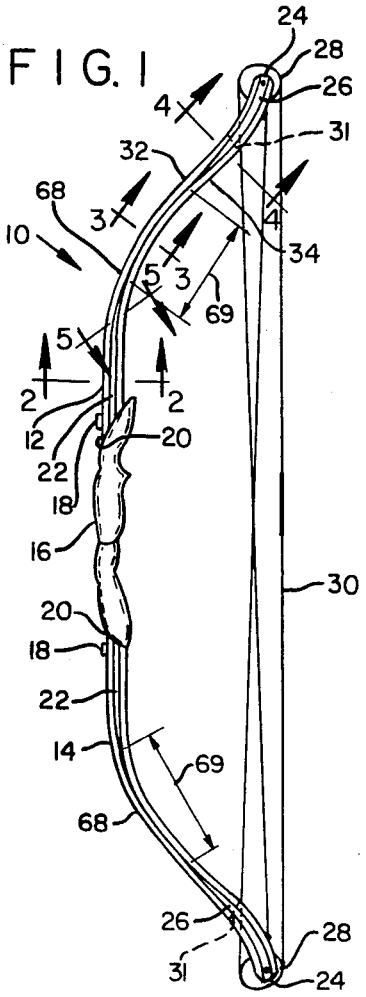
FIG. 1 is a side view of a compound bow embodying the present invention.
Figure 2:
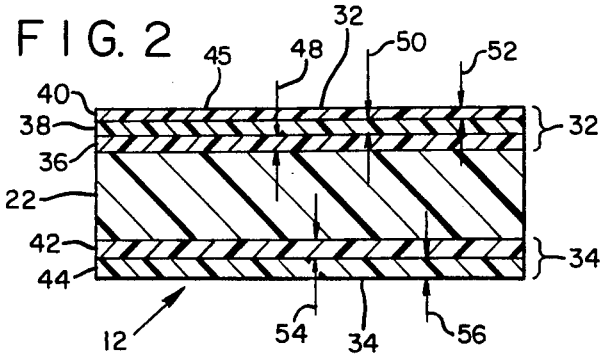
FIG. 2 is a sectional view, at an enlarged scale, taken along line 2—2 of the upper limb of the bow shown in FIG. 1.
Figure 3:
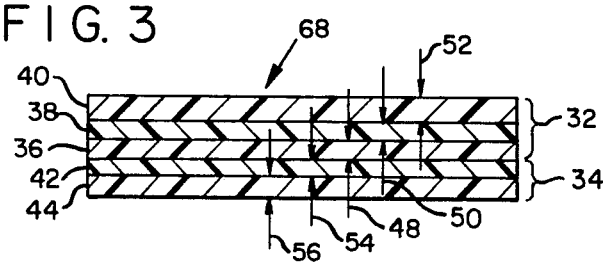
FIG. 3 is a sectional view, at an enlarged scale, taken along line 3—3 of an intermediate portion of the upper limb of the bow shown in FIG. 1.
Figure 4:
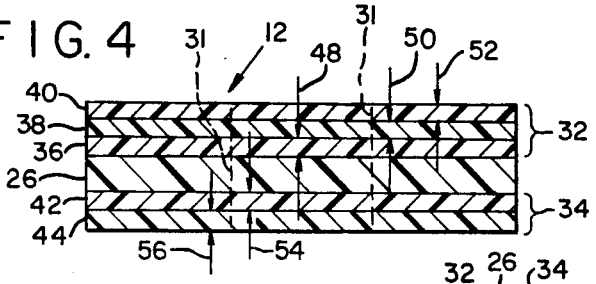
FIG. 4 is a sectional view, at an enlarged scale, taken along line 4—4 of the tip portion of the upper limb of the bow shown in FIG. 1.

Referring now to the drawings, in FIG. 1 a compound bow 10 embodying the present invention is shown. The compound bow 10 includes a pair of removable similar limbs, an upper limb 12, and a lower limb 14, each adjustably attached to a riser 16 by a respective adjustment screw 18 useable to adjust the position of the respective limb 12 or 14 with respect to the riser 16, in a conventional manner. Each of the limbs 12 and 14 includes an inner or riser end 20 including a riser wedge 22, and an outer or tip end 24 including a respective tip wedge 26. A respective wheel 28 is mounted on the tip end 24 of each of the limbs 12 and 14 in the usual manner providing for rotation of the wheel 28 with respect to the limb as the bowstring 30 is drawn and while the bow limb elastically returns to cast an arrow once the bowstring 30 has been released. It will be noted that the tip wedge 26 extends from the tip end 24 beyond the bottom of the bifurcation of the limb, indicated at 31, in which the wheel 28 is located.

As will be appreciated more clearly with reference to FIGS. 2–6, each of the limbs 12, 14 includes a laminated back layer 32 located on the outer or generally convex side of the bow. A laminated belly layer 34 is located on the inner, generally concave, side of each limb 12, 14.

Figure 5:
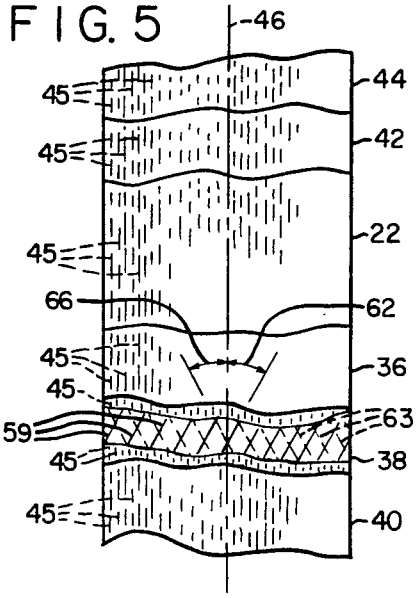
FIG. 5 is a view taken at the location indicated by the line 5—5, showing the construction of each of the laminae of the upper limb of the bow shown in FIG. 1, at an enlarged scale.

In every way relevant to the present invention, the upper limb 12 and lower limb 14 are essentially identical, and therefore only the upper limb 12 will be described herein in further detail. As shown in FIGS. 2–5, the upper limb 12 is of laminar construction. The back layer 32 includes an inner sheet or lamina 36, an intermediate sheet or lamina 38, and an outer sheet or lamina 40. The belly layer 34 includes an inner sheet or lamina 42 and an outer sheet or lamina 44. Each of the inner sheets 36 and 42 and the outer sheets 40 and 44 are of man-made fiber construction, the fibers 45 being reinforced and supported by a matrix of an epoxy resin. A uniformly distributed plurality of pre-stressed fibers 45 of material such as glass or graphite are held in tension within the epoxy resin material. The individual fibers are parallel with one another and the major surfaces and perpendicular to the thickness of each sheet of the material, which is normally planar in its relaxed state. Additionally, the fibers 45 are oriented parallel with the longitudinal axis 46 of the limb 12, as indicated in FIG. 5. Each of the inner sheets 36 and 42 and outer sheets 40 and 44 is of a uniform thickness, although the thicknesses of the various sheets of the back layer and the belly layer need not be alike, and will vary from bow to bow depending upon the pull weight desired for the bow.

Thus, the inner sheet 36 has a thickness 48, the intermediate sheet 38 has a thickness 50, the outer sheet 40 has a thickness 52, the inner sheet 42 has a thickness 54, and the outer sheet 44 has a thickness 56. In an exemplary embodiment of the invention, an upper limb 12 has a length 58, and each of the thicknesses 48, 50, 52, 54, and 56 is 0.030 inches.

Figure 6:
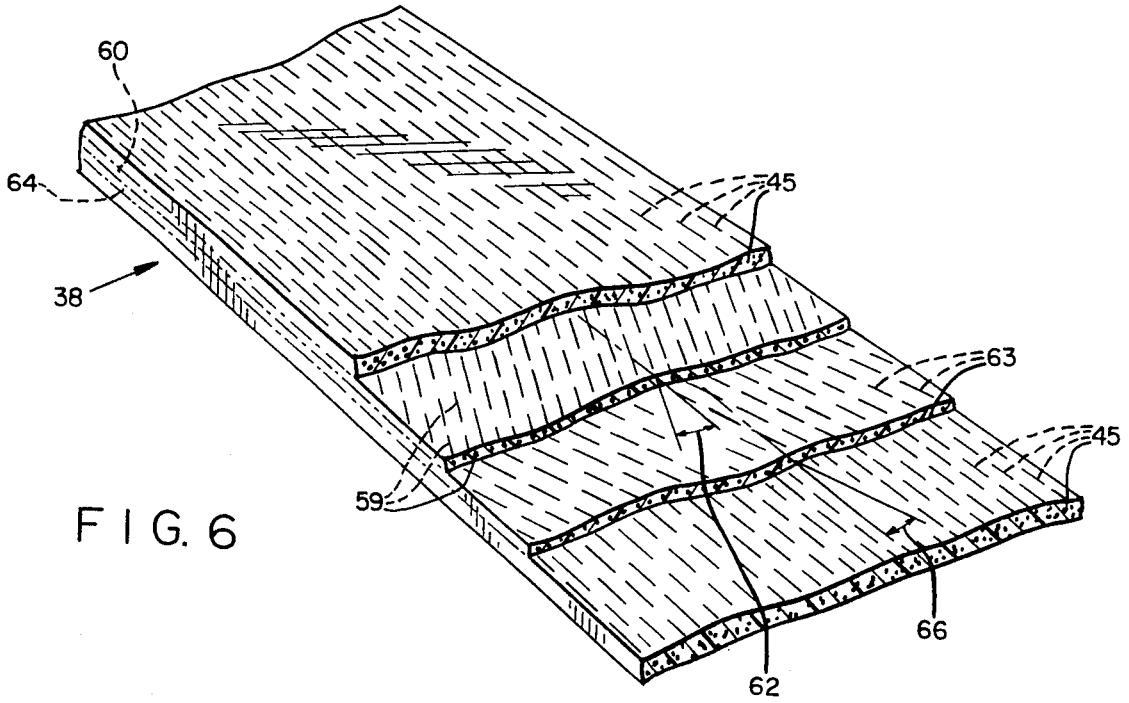
FIG. 6 is a perspective view, at an enlarged scale, of a piece of the material of one of the laminae of the limbs of the bow shown in FIG. 1, at an enlarged scale.

As may be understood better with reference to FIGS. 5 and 6, the intermediate sheet 38 of the back layer 32 is of a matrix of epoxy resin supporting a plurality of distributed fibers 59 embedded therein in a thin course 60 extending perpendicular to the thickness 50 of the intermediate sheet 38 and parallel with one another, at an angle 62, preferably equal to about 30 degrees, with respect to the longitudinal axis 46 of the limb 12. A similar number of distributed fibers 63 are parallel with each other in a second course 64, perpendicular to the thickness dimension 50 of the intermediate sheet 38, and oriented at an angle 66 substantially equal to the angle 62, but on the opposite side of the longitudinal axis 46. While 30 degrees is a preferred size of the angles 62 and 66, other angles preferably within a range of 20 to 50 degrees would also provide resistance against twisting of the limb 12. On each side of the pair of courses 60 and 64 of diagonal fibers 59 and 63 are parallel longitudinally oriented pre-stressed fibers 45 as in the inner and outer sheets or laminae 36, 40, 42 and 44. The fibers 59 and 63, like the longitudinally oriented parallel fibers 45 within the inner sheets 36 and 42 and outer sheets 40 and 44, are evenly distributed and pre-stressed within the epoxy resin matrix of the intermediate sheet 38. The fibers 59 and 63 are preferably of graphite but may be of glass. The intermediate sheet 38, with such courses 60 and 64 of fibers oriented diagonally, at equal and opposite angles is provided in order to resist any tendency of the limb 12 otherwise to twist when subjected to the rearward pull of the bowstring 30.

Adjacent the inner or riser end 20 of the limb 12, the riser wedge 22 extends toward the tip end of the limb and tapers from a maximum thickness of, for example, 0.5 inch to a sharp edge spaced apart from the riser end 20 in the longitudinal direction toward the tip end 24. At the tip end 24 of the limb 12, the tip wedge 26 is tapered from a maximum thickness of, for example, 0.3 inch, extending toward the riser end 20 of the limb and defining a sharp edge located far enough inward from the tip end 24 of the limb that the tip wedge extends laterally across the base of the U-shaped opening in which the bow's eccentric wheel is mounted. Defined by and extending longitudinally of the limb 12, between the oppositely directed sharp edges of the riser wedge 22 and tip wedge 26, is an intermediate portion 68 of the length of the limb. As shown more clearly in FIG. 3, the intermediate portion 68 includes no core or wedge material between the back layer 32 and the belly layer 34, which are adhesively interconnected with one another in the intermediate portion 68 by the same adhesive used to join the individual laminae or sheets 36, 20 38, 40, 42 and 44, and the wedges 22 and 26. The length 69 of the intermediate portion 68 may be in the range of as great as 10 inches to as little as 2 inches or less, with improved performance seen at shorter lengths 69.

Preferably, the riser wedge 22 and the tip wedge 26 are both of material similar to that of which the inner and outer sheets 36, 40, 42, and 44 are made, and fibers 45 within the riser wedge and tip wedge are oriented, preferably, parallel with the back layer 32 of the bow limb 12. Alternatively, either or both of the riser wedge 22 and tip wedge 26 may be constructed of an appropriate solid or laminated wood, which may be desirable for the sake of the appearance of the bow 10, but is inferior to the fiber reinforced resin for bow durability.

Figure 7:
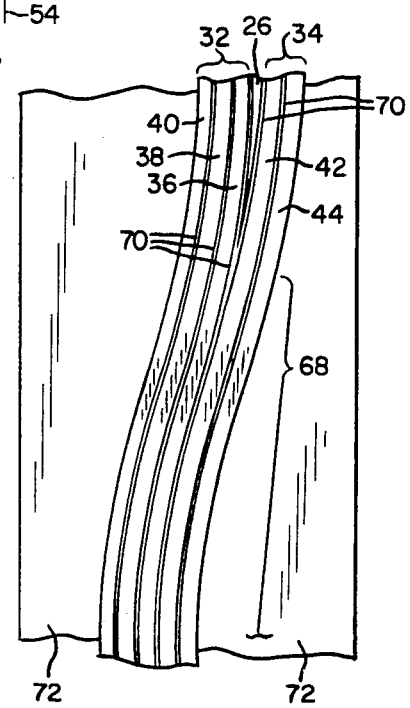
FIG. 7 is an edge view showing a portion of a bow limb according to the present invention as it is held in a press during assembly thereof.

All of the laminae (sheets 36, 38, 40, 42 and 44), and the riser wedge 22 and tip wedge 26 of the bow limbs 12 and 14 are assembled in a pre-stressed condition by laying up the individual sheets, that is, the inner sheet 36, intermediate sheet 38, outer sheet 40, the riser wedge 22 and tip wedge 26, and the inner sheet 42 and outer sheet 44, all bent individually to the required shape and interconnected by layers 70 of an efficient adhesive, as shown in FIG. 7, where the thickness of each layer of adhesive in an intermediate portion of the upper limb 12 is shown exaggerated. The various laminae are held together with the adhesive layers 70 interconnecting the respective confronting faces of each lamina of the upper limb 12 while sufficient pressure is applied by a clamping jig 72, of which only a part is shown, having the appropriate shape to give the desired curvature to the limb 12 during the time required for the adhesive in the layers 70 to reach an adequately cured condition.

A material which has been found to be satisfactory as the laminae of the limbs 12 and 14 of a bow 10 embodying the present invention is a material well known for bow construction. The material includes glass fibers in a tightly stretched pre-stressed condition and held in a flexible epoxy resin matrix of high tensile strength. Such a material is manufactured by Gordon Plastics of Vista, Calif., under the trademark BO-TUFF. This material has a glass content by weight of 66% to 71%, flexural strength of 190,000 to 210,000 psi and a modulus of elasticity of 5.0 to $6.0\times10^6$ psi, and is available in sheets of various thicknesses. The material may include a thin central layer of stretched woven glass fibers in each sheet.

An appropriate adhesive for use in making a bow limb according to the present invention is a thixotropic epoxy resin adhesive available from Ren Plastics of Lansing, Mich., under the name TDR 1100-11 Archery Adhesive. This adhesive is also well known in the bow-making industry. It may be used according to the manufacturer's instructions, mixed at the ratio of 42 parts hardener to 100 parts resin by weight, or 2 to 1 by volume, with the laminated bow limb 12 or 14 being permitted to cure while held in a jig for at least 1½ hours at a temperature of 175° F., a time and temperature combination near the low temperature end of the recommended range of times and temperatures for curing of that adhesive.

As a result of construction of the limbs 12 and 14 in accordance with the present invention, without any intermediate core member of wood between the back and belly layers, as has previously been thought necessary for the construction of bow limbs, a bow limb manufactured according to the present invention has surprisingly been able to withstand without failure thousands of cycles of the bowstring 30 being drawn to a fully drawn condition of the compound bow 10 and thereafter released without the load of an arrow, in contrast to the usual failure of a compound bow limb after one, or at most, a few such releases of the bowstring without the load of an arrow.

Figure 8:
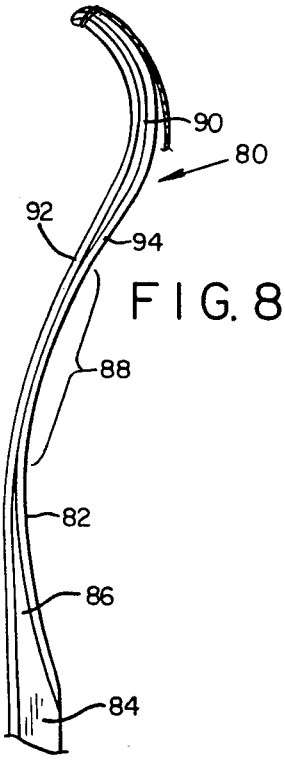
FIG. 8 is a side view of an upper limb of a recurved longbow whose limbs are constructed according to the present invention.

As shown in FIG. 8, a simple, or "stick," bow 80 includes an upper limb 82 and a lower limb, not shown, of essentially symmetric construction and formed together with the upper limb 82. The bow 80 includes a riser portion 84, located between the limbs and extending upwards in the form of a riser wedge 86. Separated from the riser wedge 86 by an intermediate portion 88 there may be a tip wedge 90. The bow 80 includes a back layer 92 which extends for the entire length of both the upper limb 82 and the lower limb. A belly layer 94 extends from the tip of the upper limb 82 to the riser 84 on the belly side of the riser wedge 86. The back layer 92 and belly layer 94 are of laminated construction similar to that of the back layer 32 and belly layer 34 of the limb 12. Thus, the construction of each limb of the bow 80 is similar to the construction of the limbs 12 and 14 of the compound bow 10 shown in FIGS. 1–7. As a result, the intermediate portion 68 of the limb 12 of the compound bow and the intermediate portion 88 of the upper limb 82 of the bow 80 are of flexible, durable, yet powerful pre-stresssed construction, resulting in a bow able to cast arrows with greater speed and energy than previously available laminated fiberglass bows utilizing wood or other core materials of other than pre-stressed construction.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. An archery bow having a pair of elongate limbs of laminated pre-stressed construction, each limb comprising:

(a) a back layer having a plurality of back layer laminae, each of said back layer laminae including a plurality of pre-stressed reinforcing fibers extending parallel with one another and longitudinally of said limb and being embedded in a resin matrix;

(b) a belly layer having a plurality of belly layer laminae, each of said belly layer laminae including a plurality of pre-stressed reinforcing fibers extending parallel with one another and longitudinally of said limb and being embedded in a resin matrix;

(c) a pair of opposite end portions and an intermediate portion located therebetween, between, said intermediate portion being free of any core material located between said belly layer laminae and said back layer laminae and substantially all reinforcing fibers present in said intermediate portion being pre-stressed; and (d) all of said laminae being fixedly interconnected with one another in a pre-stressed arcuately curved configuration with respective confronting faces of said laminae adhesively interconnected with one another over their entire confronting surfaces within each of said belly and back layers.

2. An archery bow having a pair of elongate limbs of pre-stressed laminated construction, each limb comprising:

(a) a back layer including a plurality of back layer laminae of resin material supporting a pluraity of pre-stressed man-made fibers oriented parallel with one another and longitudinally of said limb, each of said back layer laminae being biased by its own elasticity toward a planar configuration in which said fibers are straight;

(b) a belly layer including a plurality of belly layer laminae of resin material supporting a plurality of pre-stressed man-made fibers oriented parallel with one another and longitudinally of said limb, each of said belly layer laminae being biased by its own elasticity toward a planar configuration in which said fibers are straight;

(c) *said limb including a riser end and a tip end and* having a riser wedge located between said back layer and said belly layer adjacent said riser end;

(d) a tip wedge located between said back layer and said belly layer proximate said tip end, said tip wedge being spaced apart from said riser wedge by a predetermined distance longitudinally along said limb, defining an intermediate portion of said limb located between said riser wedge and said tip wedge; and (e) said back layer laminae being bonded directly to one another by an adhesive within said back layer, said belly layer laminae being bonded directly to one another by an adhesive within said belly layer, and a respective one of said back layer laminae being bonded directly to a respective one of said belly layer laminae by an adhesive throughout said intermediate portion.

3. The bow of claim 2 wherein said riser wedge and tip wedge are of resin material including prestressed parallel glass fibers oriented longitudinally of said limb.

4. The bow of claim 2 wherein said intermediate portion of each limb is pre-stressed and includes an arcuate curvature when said limb is in a relaxed condition.

5. The bow of claim 2 wherein the resin of said laminae of said back layer and said belly layer is an epoxy resin, and wherein the components of each limb, including said laminae, are permanently joined together by a bonding layer of a thixotropic epoxy adhesive.

6. The bow of claim 2 wherein said back layer includes at least three back layer laminae, an intermediate one of said back layer laminae having opposite major faces and including a longitudinal axis and having a plurality of pre-stressed fibers in a resin matrix, all of said fibers extending parallel to said opposite major faces of said intermediate one of said back layer laminae and a first plurality of said fibers being parallel with one another and oriented at a diagonal angle with respect to said longitudinal axis of said one of said back layer laminae, and a second plurality of said fibers being oriented parallel with one another and being oriented at an equal but opposite diagonal angle with respect to said longitudinal axis of said one of said back layer laminae.

7. The bow of claim 6, said back layer having at least two laminae of longitudinally oriented fiber, at least one of said laminae having longitudinally oriented fiber located on each side of said intermediate lamina, and a majority of said first plurality of fibers oriented at a diagonal angle and of said second plurality of fibers oriented at an opposite diagonal angle being of graphite material.

8. The bow of claim 2 wherein said belly layer includes at least two adhesively interconnected pre-stressed laminae having longitudinally oriented fibers.

9. The bow of claim 2 wherein said limbs are bent in a pre-stressed reflex curvature in which each of said belly and back layers includes an arcuately curved portion when said bow is in a relaxed, unstrung, condition.

10. The bow of claim 2 wherein each of said limbs is arcuately curved in a pre-stressed recurve configuration in which each of said belly and back layers includes an arcuately curved portion when said bow is in a relaxed, unstrung, condition.

11. A pre-stressed laminated limb for a compound bow, comprising:

(a) a back layer including a plurality of back layer laminae of pre-stressed fibers oriented parallel with one another and longitudinally of said limb in a matrix of resin material, each of said back layer laminae being biased by its own elasticity toward a planar configuration in which said fibers are straight;

(b) a belly layer including a plurality of belly layer laminae of pre-stressed fibers oriented parallel with one another and longitudinally of said limb in a matrix of resin material, each of said belly layer laminae being biased by its own elasticity toward a planar configuration in which said fibers are straight;

(c) said limb including a riser end and a tip end and having a riser wedge located between said back layer and said belly layer adjacent said riser end;

(d) a tip wedge located between said back layer and said belly layer proximate said tip end, said tip wedge being spaced apart from said riser wedge by a predetermined distance longitudinally along sasid limb defining an intermediate portion of said limb located between said riser wedge and said tip wedge; and (e) said back layer laminae being bonded directly to one another by an adhesive within said back layer, said belly layer laminae being bonded directly to one another by an adhesive within said belly layer, and respective one of said back layer laminae and belly layer laminae being bonded directly to each other by an adhesive throughout said intermediate portion.

12. A method for manufacturing a bow limb, comprising:

(a) providing respective belly and back layers, each including a plurality of laminae, each of said laminae having respective major surfaces and including a plurality of parallel pre-stressed fibers oriented parallel with one another and with said major surfaces of each respective lamina and held in a matrix of synthetic resin material;

(b) providing a tip wedge and a riser wedge of parallel pre-stressed fibers held in a matrix of synthetic resin, said fibers being oriented longitudinally of said tip wedge and said riser wedge;

(c) applying a layer of an epoxy adhesive to respective surfaces of each of said laminae and said tip and riser wedges;

(d) laying up and pressing together said laminae and said wedges in a predetermined arcuate configuration of said limb in which said back layer and belly layer are adhesively connected directly to one another over an intermediate portion of said limb located between said tip wedge and said riser wedge so that each of said laminae independently assumes a respective curvature before said adhesive immovably interconnects each lamina to an adjacent one; and (e) curing said adhesive until said laminae and said riser and tip wedges are fixedly interconnected with one another as an integral limb.

13. The method of claim 12, including pressing said laminae and wedges together for a predetermined time at a predetermined temperature duriing curing of said adhesive.

14. The method of claim 13 wherein said predetermined temperature is no more than about 175° F. and said predetermined time is at least about 90 minutes.

15. The method of claim 12 including the further step of shaping said limb to a final configuration after said adhesive has cured.

16. An archery bow having a pair of elongate limbs of laminated pre-stressed construction, each limb comprising:

(a) a back layer including at least one back lamina, each said back lamina including a plurality of pre-stressed reinforcing fibers extending parallel with one another and longitudinally of said limb and being embedded in a resin matrix;

(b) a belly layer including at least one belly lamina, each said belly lamina including a plurality of pre-stressed reinforcing fibers extending parallel with one another and longitudinally of said limb and being embedded in a resin matrix;

(c) each said limb having a opposite end portions and a tip wedge and a riser wedge extending toward each other from respective ones of said opposie end portions and defining an intermediate portion located therebetween, said intermediate portion being free of any core material located between said belly layer and said back layer; and (d) all of said back layer, said belly layer, said tip wedge, and said riser wedge being fixedly interconnected with one another in a pre-stressed arcuately curved configuration with respective confronting faces of said belly layer and said back layer being adhesively interconnected with one another over their entire confronting surfaces within said intermediate portion.

* * * * *

UNITED STATES PATENT AND TRADEMARK OFFICE

CERTIFICATE OF CORRECTION

PATENT NO. : 4,712,533

DATED : December 15, 1987

INVENTOR(S) : Billy J. Cruise

It is certified that error appears in the above-identified patent and that said Letters Patent is hereby corrected as shown below:

| | | |
|---|---|---|
| Col. 5, | line 62 | Delete "20". |
| Col. 7, | line 49 | Delete "between,"; |
| | line 65 | Change "pluraity" to --plurality--. |
| Col. 9, | line 30 | Change "sasid" to --said--; |
| | line 38 | Change "one" to --ones--. |
| Col. 10, | line 19 | Change "duriing" to --during--; |
| | line 40 | Delete "a"; |
| | line 42 | Change "opposie" to --opposite--. |

Signed and Sealed this

Twenty-sixth Day of July, 1988

*Attest:*

DONALD J. QUIGG

*Attesting Officer*

*Commissioner of Patents and Trademarks*